US012716210B2

(12) United States Patent
Hodel et al.

(10) Patent No.: US 12,716,210 B2
(45) Date of Patent: Aug. 25, 2026

(54) SYSTEM FOR DIG STALL RECOVERY

(71) Applicant: Caterpillar Inc., Peoria, IL (US)

(72) Inventors: Benjamin J. Hodel, Dunlap, IL (US); Jeffrey K. Berry, Clayton, NC (US); Mo Wei, Dunlap, IL (US); Adam Martin Nackers, Washington, IL (US); Justin Lee Steinlage, Mackinaw, IL (US)

(73) Assignee: Caterpillar Inc., Peoria, IL (US)

( * ) Notice: Subject to any disclaimer, the term of this patent is extended or adjusted under 35 U.S.C. 154(b) by 64 days.

(21) Appl. No.: 18/658,086

(22) Filed: May 8, 2024

(65) Prior Publication Data

US 2025/0347090 A1 Nov. 13, 2025

(51) Int. Cl.

| | |
|---|---|
| ***E02F 3/32*** | (2006.01) |
| ***E02F 3/43*** | (2006.01) |
| ***E02F 9/22*** | (2006.01) |
| ***E02F 9/26*** | (2006.01) |

(52) U.S. Cl.

CPC ..... *E02F 9/265* (2013.01); *E02F 3/32* (2013.01); *E02F 3/435* (2013.01); *E02F 9/2278* (2013.01)

(58) Field of Classification Search

None

See application file for complete search history.

(56) References Cited

U.S. PATENT DOCUMENTS

| | | | | |
|---|---|---|---|---|
| 5,461,803 | A | 10/1995 | Rocke | |
| 6,101,437 | A | 8/2000 | Oshina et al. | |
| 7,832,126 | B2 | 11/2010 | Koellner et al. | |
| 7,979,181 | B2 | 7/2011 | Clark et al. | |
| 8,340,875 | B1 | 12/2012 | Shatters et al. | |
| 9,031,760 | B2 | 5/2015 | Shirao | |
| 9,435,105 | B2 | 9/2016 | Fleischmann et al. | |
| 9,598,837 | B2 | 3/2017 | Fletcher et al. | |
| 10,669,691 | B2 | 6/2020 | Tinker et al. | |
| 11,512,446 | B2 | 11/2022 | Breutzman et al. | |
| 2008/0097672 | A1* | 4/2008 | Clark | E02F 3/437 701/50 |
| 2010/0322753 | A1* | 12/2010 | Brooks | B66C 23/90 414/718 |
| 2018/0373275 | A1 | 12/2018 | Beschorner et al. | |
| 2021/0222405 | A1 | 7/2021 | Velde et al. | |
| 2022/0412050 | A1 | 12/2022 | Hoaby et al. | |

FOREIGN PATENT DOCUMENTS

| | | |
|---|---|---|
| CN | 102936906 | 3/2016 |

OTHER PUBLICATIONS

Written Opinion and International Search Report for Int'l. Patent Appln. No. PCT/US2025/025129, mailed Sep. 9, 2025 (07 pgs).

* cited by examiner

*Primary Examiner* — James M McPherson

(57) ABSTRACT

A work machine can include a frame; a work tool coupled to the frame wherein the work tool includes a boom, a stick, and a bucket combination; a hydraulic system to provide power to operate the work tool; one or more sensors coupled to the work tool to detect a velocity of the stick and the bucket or a force applied by the stick and the bucket; and a controller coupled to the sensors and configured to detect, during a dig process, a stall or an impending stall of one or more of the stick and the bucket from information from the sensors, and configured to operate the work tool in a dig stall recovery mode when the stall or the impending stall is detected.

17 Claims, 7 Drawing Sheets

SYSTEM FOR DIG STALL RECOVERY

TECHNICAL FIELD

This disclosure relates to construction equipment, and more specifically to an excavator.

BACKGROUND

Excavators and other work machines can use a boom, stick, and bucket to move dirt or other materials using controls positioned within an operator station of the machine.

However, when the excavator digs in the ground, it can meet resistance to the point where the velocity stalls and the linkage stops moving even when full stick-in or bucket-curl commands are given. If a stall happens, then the dig cycle either cannot proceed or the operator must abort the dig to dump with low payload which results in low productivity and low fuel efficiency.

U.S. Pat. No. 9,598,837 discusses a load-haul-dump machine with a controller configured to determine that a first actuator is experiencing a stall condition.

SUMMARY

In an example according to this disclosure, a work machine can include a frame; a work tool coupled to the frame wherein the work tool includes a boom, a stick, and a bucket combination; a hydraulic system to provide power to operate the work tool; one or more sensors coupled to the work tool to detect a velocity of the stick and the bucket or a force applied by the stick and the bucket; and a controller coupled to the sensors and configured to detect, during a dig process, a stall or an impending stall of one or more of the stick and the bucket from information from the sensors, and configured to operate the work tool in a dig stall recovery mode when the stall or the impending stall is detected.

In another example according to the present disclosure, a system for controlling operation of a work machine can include a hydraulic system to provide power to operate a work tool of a work machine, the work tool including a boom, a stick, and a bucket combination; a plurality of sensors coupled to the stick and the bucket; and a controller coupled to the sensors and configured to detect, during a dig process, a stall or an impending stall of one or more of the stick and the bucket from information from the sensors, and configured to operate the work tool in a dig stall recovery mode when the stall or the impending stall is detected, and then to deactivate the recovery mode and continue the dig process until another stall or impending stall is detected or the dig process is complete.

In another example according to the present disclosure, a work machine can include a frame; transportation devices coupled to the frame; a work tool coupled to the frame wherein the work machine is an excavator machine and the work tool includes a boom, a stick, and a bucket combination; a hydraulic system to provide power to operate the work tool; sensors to detect movement of the frame; and a controller coupled to the sensors and configured to detect a movement of the frame from information from the sensors and configured to operate in a movement inhibition mode when the movement is detected.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
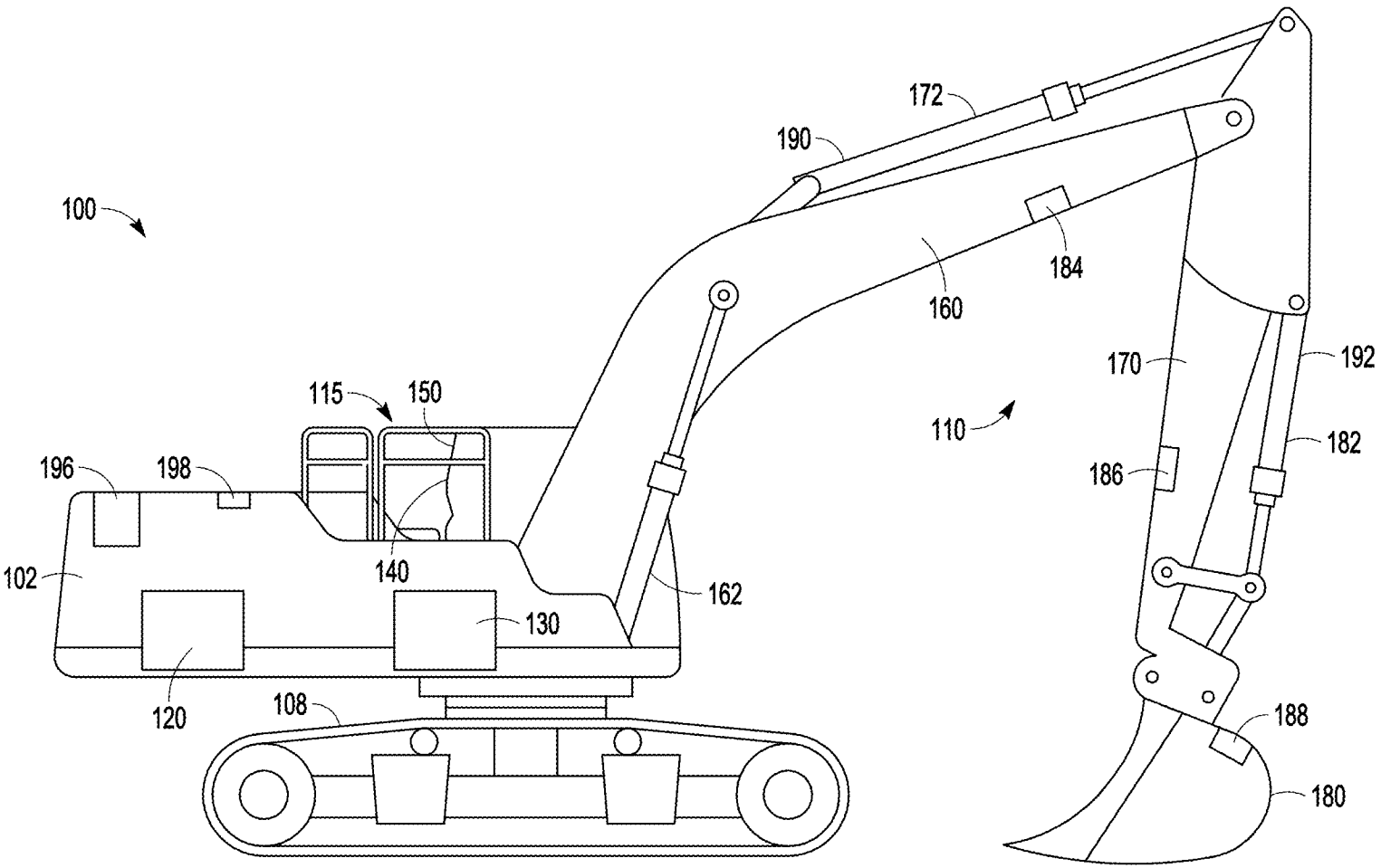
FIG. 1 shows a side view of an excavator machine, in accordance with one embodiment.

FIG. 1 shows a side view of a work machine 100, such as an excavator machine 100, in accordance with at least one example of the present disclosure. The work machine 100 can include a chassis or frame 102 and transportation devices 108 coupled to the frame 102. For example, the transportation devices 108 can include wheels or tracks. As part of the movement of work machine 100, the work machine 100 can also provide steering capability to the work machine 100 via the transportation devices 108. For example, the work machine steering can be accomplished by a skid-steer system or by turning of the transportation devices 108. The work machine 100 further includes a work tool 110 coupled to the frame 102, and a hydraulic system 120 to provide power to operate the transportation devices 108 and the work tool 110.

As noted, the work machine 100 can include an excavator machine 100 and the work tool 110 can include a boom 160, a stick 170, and a work implement such as a bucket 180 which act in combination. In one example, the excavator machine can be an electro-hydraulically controlled excavator machine. For example, the boom 160, stick 170, and the bucket 180 can be operated via hydraulic cylinders 162, 172, and 182, respectively, operated via a controller 130 which can be used to coordinate the movements and actions of the work tool 110.

An operator station 115 on the work machine 100 can be used to operate the work machine 100. In various examples, the operator station 115 can include a monitor 150 which can provide input/output information to the machine operator. Further one or more input devices 140 and other controls can be mounted within the operator station 115 for controlling the operation of the work machine. For example, such operations can include operating an engine of the work machine 100, operating the transportation devices 108 and steering of the work machine 100, operating the hydraulic system 120, and operating the boom 160, the stick 170 and the implement 180. In other embodiments, the operator station can include a remote operator station located remotely from the machine.

The hydraulic system 120 can include one or more hydraulic pumps connected to the engine of the work machine 100 and can be powered thereby. In some examples, the hydraulic pumps can be connected to one or more valves for controlling and distributing hydraulic fluid to various hydraulic actuators of the work machine 100, such as the hydraulic cylinders 162, 172, 182 and the steering and transportation devices 108.

Each of the hydraulic cylinders 162, 172, and 182 can be connected to and powered by the hydraulic system 120, as noted above. The hydraulic cylinder 162 can be connected to the frame 102 and the boom 160; the hydraulic cylinder 172 can be connected to the boom 160 and the stick 170; and the hydraulic cylinder 182 can be connected to the stick 170 and indirectly to the implement 180 via a powerlink.

In operation of some examples, an operator can use controls and input devices within the operator station 115 to move the work machine 100 using the transportation devices 108. The operator can further articulate the boom 160 and stick 170 to position the implement 180 relative to the frame 102 to perform various tasks, such as moving dirt and other materials during an excavating process.

In one example, the excavator 100 can include a plurality of sensors 184, 186, 188, 190, and 192. Each of the sensors 184, 186, 188, 190, 192 can be connected to the controller 130 to deliver information to the controller during a dig process. For example, the sensors 184, 186, and 188 can be IMU sensors coupled to the boom 160, the stick 170, and the bucket 180, respectively. In one example, the sensors 184, 186, 188 can include IMU sensors to determine the angular position and angular velocity of the boom 160, the stick 170, and the bucket 180. Moreover, the machine 100 can further include one or more linear position sensors associated with each of the hydraulic cylinders 162, 172, 182 to determine the linear position, or velocity of each of the cylinders 162, 172, 182. In one embodiment, the sensor 188 coupled to the bucket can include a non-contact AMR (rotary) sensor in a pin that connects the idler and the stick. From this angle/angular velocity, the bucket angle/angular velocity can be calculated.

In one example, sensors 190 and 192 can be pressure sensors associated with the hydraulic cylinders 172 and 182, respectively. The pressure sensors 190 and 192 can be used as a proxy to determine the amount of force being applied by the implement at any given moment. In one example, force sensors can be coupled to proximate the stick 170 and the bucket 180 to directly or indirectly measure the force applied on the tools.

In various examples, the excavator 100 can be operated by an on board operator, or the machine can be autonomous, or the machine can be semi-autonomous.

As noted above, sometimes when an excavator digs in the ground, it can meet resistance to the point where the velocity stalls and the linkage stops moving. If such a stall happens, then the dig cycle either cannot proceed or the operator must abort the dig to dump with low payload which results in low productivity and low fuel efficiency.

To illustrate the problem, FIGS. 2-5 show an example of a typical dig process.

Figure 2:
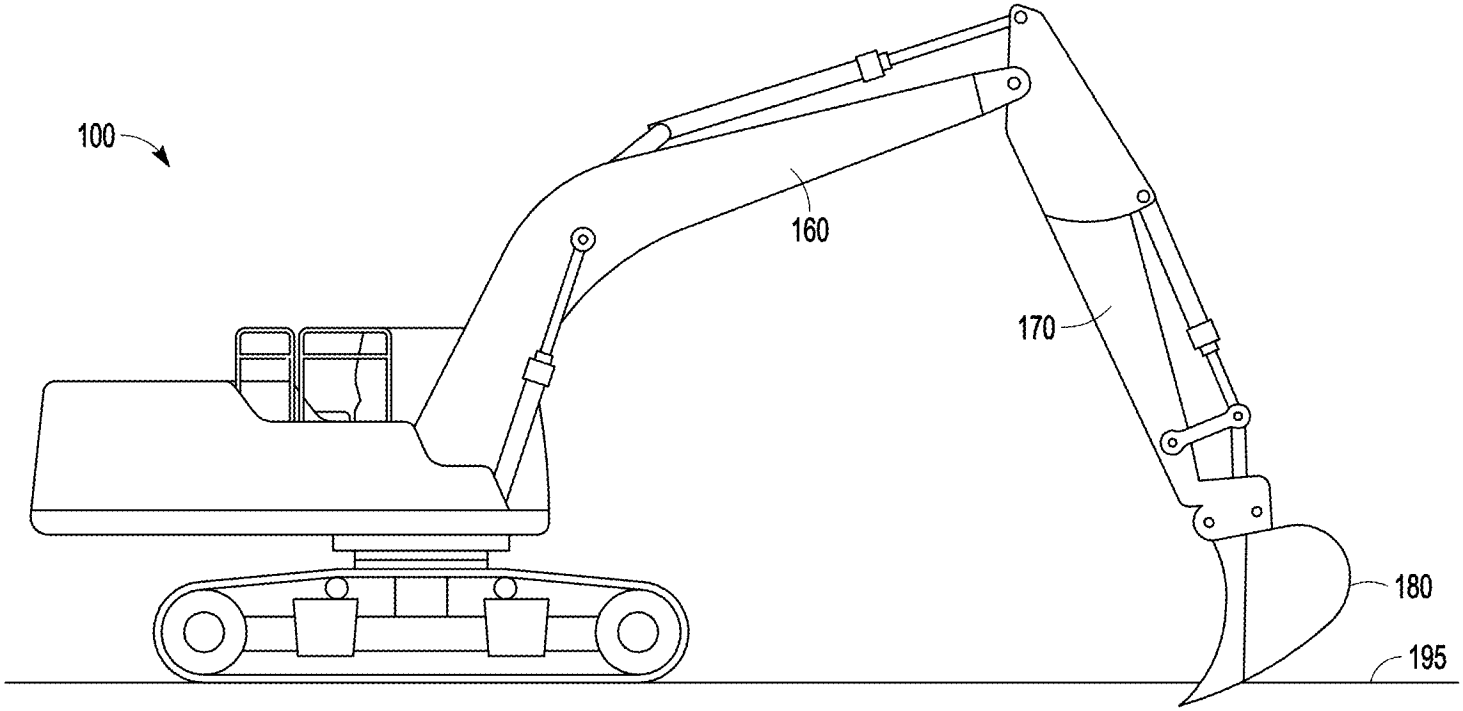
FIG. 2 shows a schematic representation of an excavator machine during a dig process, in accordance with one embodiment.

FIG. 2 shows a schematic side view of the excavator 100 at the start of a dig, where the boom is extended out and the stick 170 begins swinging forward rotating at the joint between the boom 160 and the stick 170 and driven by cylinder 172 (FIG. 1) such that the bucket 180 enters into the ground 195. In another dig scenario, the bucket 180 rotates forward to perform a bucket dig by rotating at the joint between the stick 170 and the bucket 180 and driven by cylinder 182 (FIG. 1). In another dig scenario, both the stick 170 and the bucket 180 can be rotated during a dig.

Figure 3:
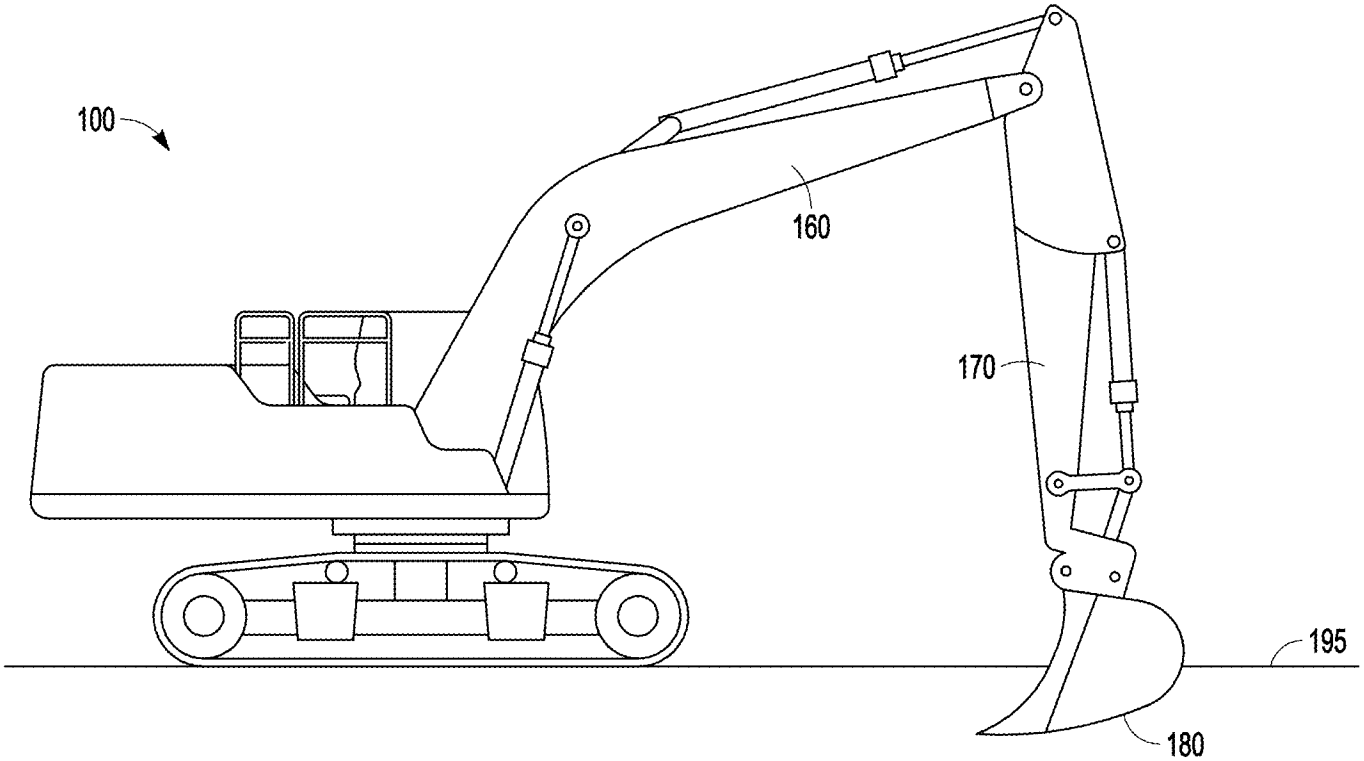
FIG. 3 shows a schematic representation of an excavator machine during a dig process, in accordance with one embodiment.

FIG. 3 shows a schematic side view of the excavator 100 when the excavator 100 experiences a stall condition. In this situation, the stick 170 and/or the bucket 180 are unable to move farther into the ground 195.

Figure 4:
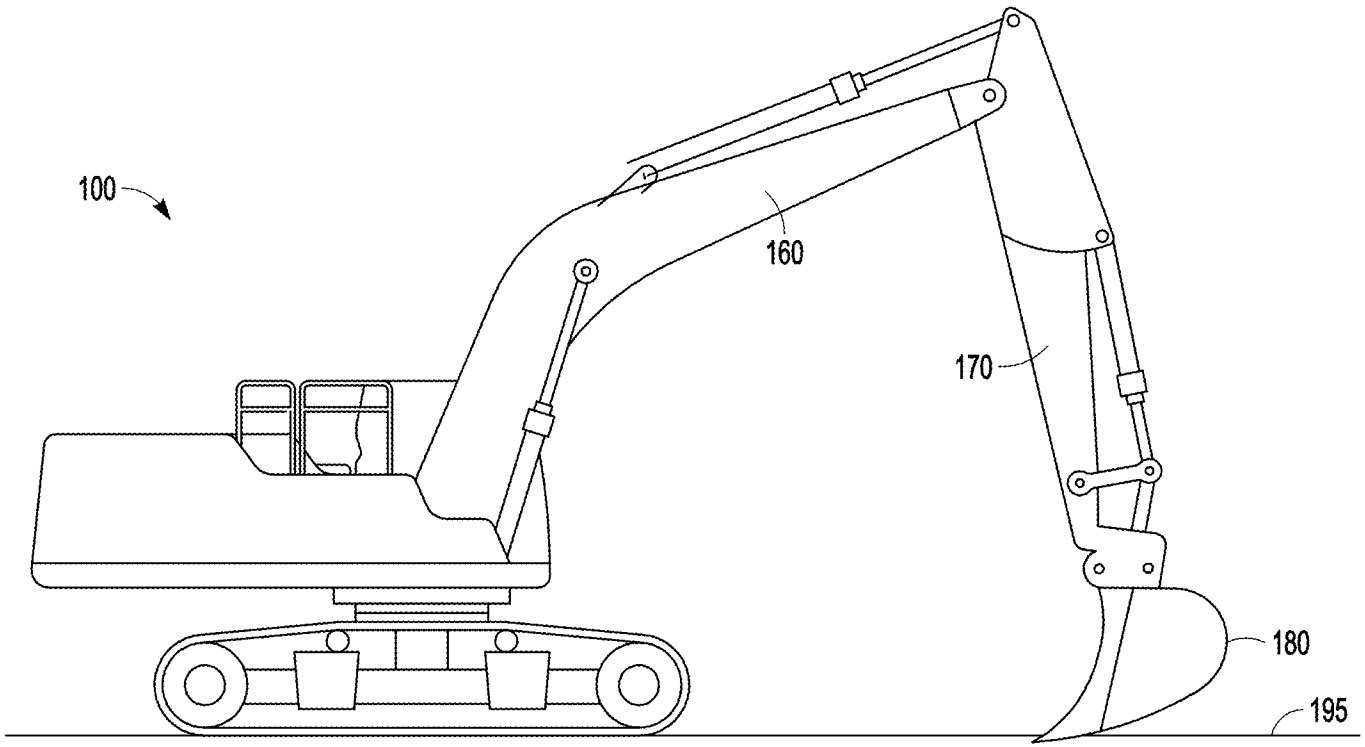
FIG. 4 shows a schematic representation of an excavator machine during a dig process, in accordance with one embodiment.

FIG. 4 shows a side schematic view of the excavator 100 after a recovery from the stall condition. Here, as will be detailed below, the boom 160 has been raised up relative to the situation of FIG. 3.

Figure 5:
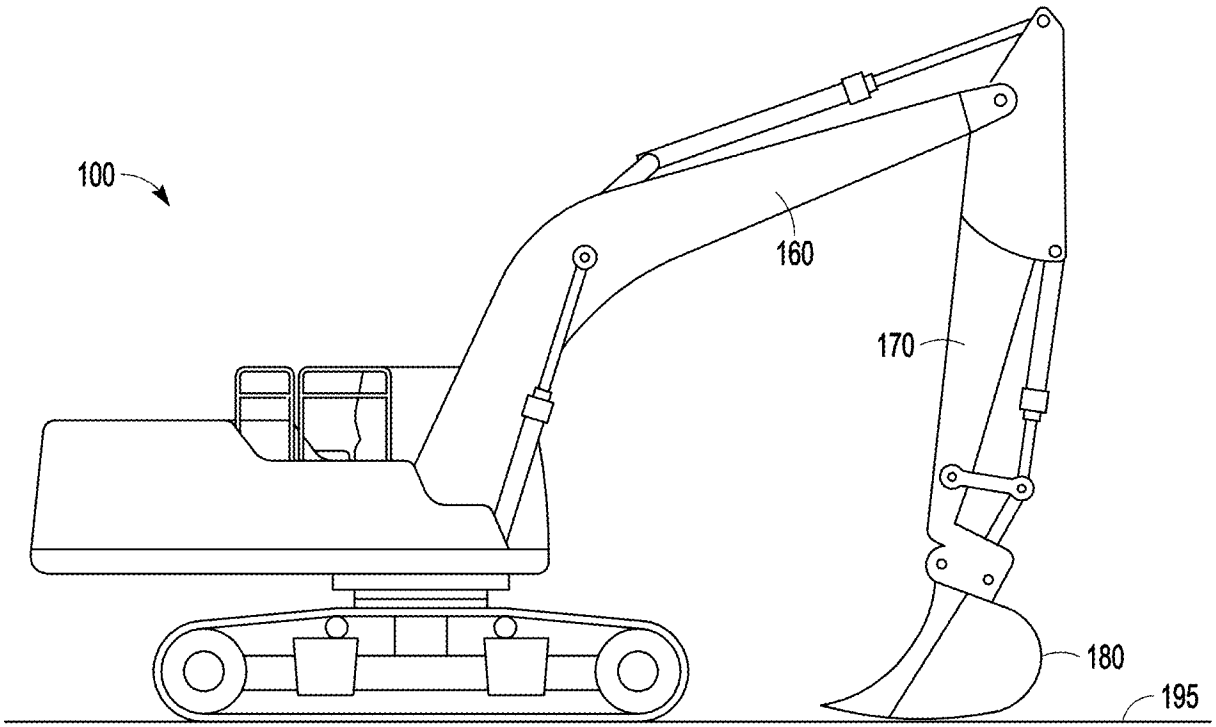
FIG. 5 shows a schematic representation of an excavator machine during a dig process, in accordance with one embodiment.

FIG. 5 shows a side schematic view of the excavator 100 after the dig is complete.

As will be detailed below, the present system provides a dig stall recovery system to detect the stall, activate a recovery action, and deactivate the recovery action. Further, the present system includes a process for special handling for when recovery fails, or when the chassis or frame 102 moves undesirably during a dig process.

Figure 6:
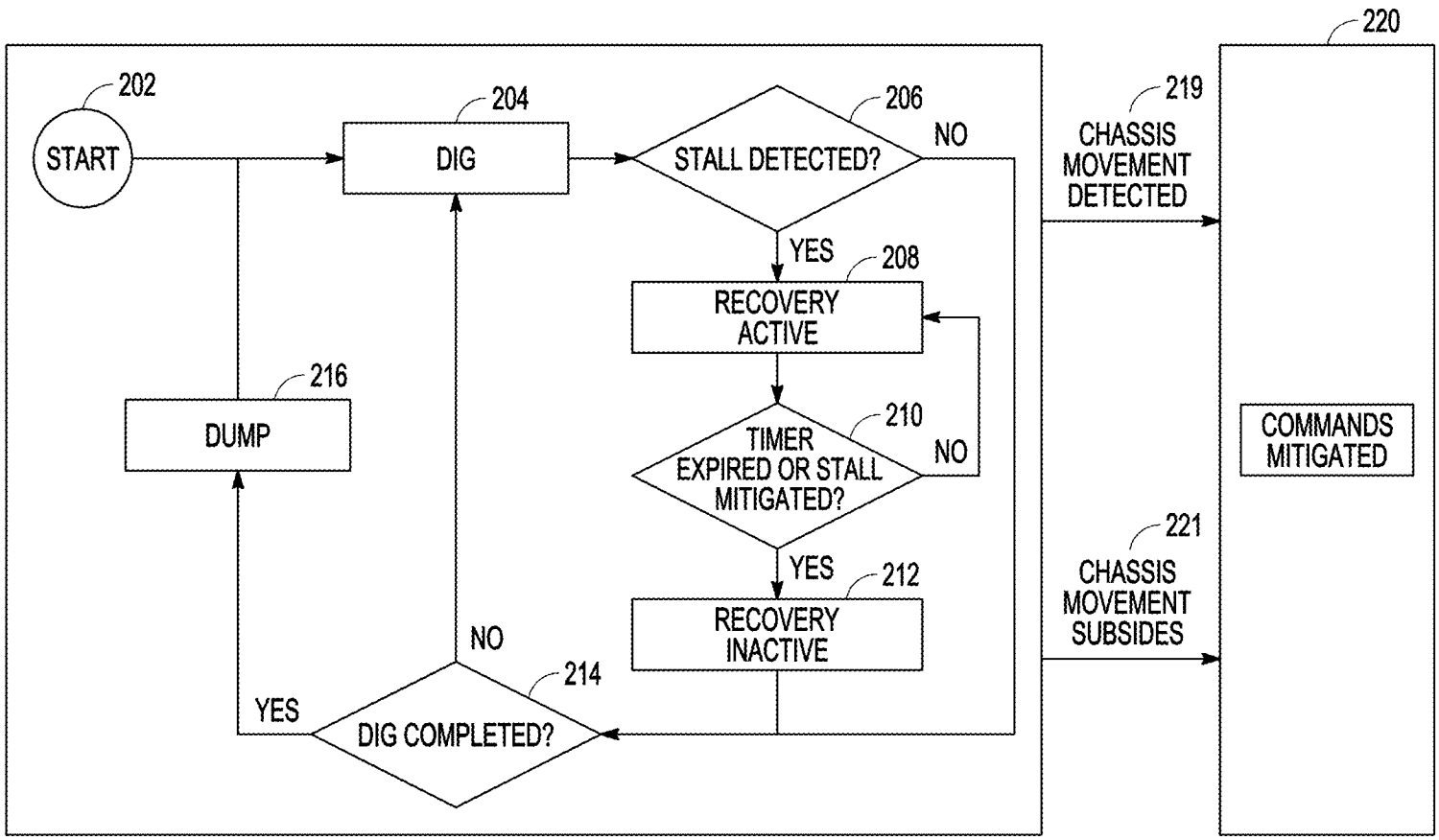
FIG. 6 shows a schematic representation a control system for a dig operation, in accordance with one embodiment.

FIG. 6 shows a schematic diagram of a system and method for controlling operation of a work machine during a dig process. Referring also to FIG. 1, in general the system is enabled using the controller 130, discussed above, in association with the plurality of sensors coupled to the machine 100.

In use, the dig process starts at block 202 and the controller gives a dig command at block 204. The process will continue until the dig is complete at block 214 unless a stall or impending stall is detected at block 206. As noted above, the controller 130 can be coupled to the plurality of machine sensors and be configured to detect, during the dig process, a stall or an impending stall of one or more of the stick and the bucket from information from the sensors.

If a stall is detected at block 206, the controller 130 can be configured to operate the work tool in a dig stall recovery mode at block 208, and then to deactivate the recovery mode at blocks 210 and 212 and continue the dig process until another stall or impending stall is detected or the dig process is complete.

Accordingly, if the dig is not complete at block 214 and if the controller 130 detects another stall or impending stall during a single dig, the controller 130 will re-activate the dig stall recovery mode at block 208, and then deactivate the recovery mode and continues to dig until another stall is detected or the dig is complete.

As will be further detailed below, during the entire dig process, the controller 130 also can be configured to monitor frame 102 or chassis movements at block 219 and dig commands can be mitigated at block 220. In one example, if a frame movement is detected at any point in the dig process the controller 130 can mitigate or inhibit any commands to the work tools until the movement subsides at block 221.

In various embodiments, the signals received from sensors 184-192 may need to be debounced, filtered or accumulated to remove noise. Thus, the controller 130 can be configured to filter out any noise from velocity or force signals received the sensors. Moreover, the controller 130 can include a debounce function so that after a signal crosses a given threshold, the controller 130 can reject momentary crosses of the threshold. In one example to remove signal noise, a cumulative sum of signals can also be used to look at a signal trend over time and not a discrete instantaneous measure.

In one embodiment, a stall can be detected at block 206 when an implement function (the stick 170 or the bucket 180) is commanded to move, but insufficient motion of the implement or excessive force on the implement is observed.

For example, the sensor 186 on the stick 170 may indicate that the stick 170 is not moving as much or with the velocity it should be moving given the present command. Likewise, the sensor 190 may indicate that the pressure in the hydraulic cylinder 172 is higher than it should be given the command, and thus the force is too high. In one example, the sensor 188 on the bucket 180 may indicate that the bucket 180 is not moving as much or with the velocity it should be moving given the present command. Likewise, the sensor 192 may indicate that the pressure in the hydraulic cylinder 182 is higher than it should be given the command, and thus the force is too high.

In one example, the controller 130 can be given a threshold number that indicates that the sensor 186, 188 or the pressure sensor 190, 192 has sensed a stall condition.

Thus, in one embodiment, the controller 130 can be configured to detect a stall or an impending stall when a velocity of the stick 170 falls below the pre-determined threshold. The velocity can be the angular velocity of the stick 170 determined from an IMU sensor or a cylinder velocity measured from the velocity of the cylinder 172. Likewise, in some embodiments, the controller 130 can also analyze the bucket angular velocity or cylinder velocity to determine if a stall is occurring.

Thus, stall detection can occur when the stick 170 or the bucket 180 is commanded to move, and the angular velocity of the stick, or the bucket falls below a threshold. As noted above, one or more sensors can be coupled to the cylinders 172, 182 to determine cylinder velocity. This information can be delivered to the controller 130 and the controller 130 can determine from the signals that a stall is occurring.

As noted, a stall can also be detected by detecting the forces on the implements. For example, a force sensor or a pressure sensor (acting as a proxy force sensor) can be used, such as pressure sensors 190, 192 on the hydraulic cylinders 172, 182 driving the stick and the bucket. Thus, the system can further include the sensors 190, 192 coupled to the hydraulic system and wherein the controller 130 is configured to detect the stall or the impending stall from information from the sensors 190, 192 when a force applied to the bucket 180 or the stick 170 is above a pre-determined threshold.

Using one or more of the above stall detection methods, the controller 130 can then activate the stall recovery mode at block 208. In the stall recovery mode, the controller 130 can activate certain boom functions. For example, the controller 130 can deliver boom up commands. These commands cause the boom 160 to move upwards a certain amount. For example, the boom up action can be discrete motions or can be modulated as a function of the velocity or force detected.

Thus, in the dig stall recovery mode the controller 130 can move the boom 160 with discrete boom up actions while one or both of the stick 170 and the bucket 180 continues the dig process. For example, the boom 160 can be moved by boom pumping where the boom 160 is moved up three times over a ½ second or a 1 second time period. Then the controller 130 can analyze from the sensors whether the stall or impending stall condition still exists. Thus, during a single dig process, there can be one or more stall moments.

In some examples, in the dig stall recovery mode, the controller can move the boom 160 with modulated boom up actions while the stick 170 or the bucket 180 continues the dig process. For example, if the boom up actions are modulated, the controller 130 can choose the movements of the boom 160 as a function of a present angular velocity of the stick 170 or bucket 180 or a calculated force on the stick 170 or bucket 180. Thus, for example, if velocity of the stick 170 or bucket 180 is slowing down, the controller 130 can deliver just a light boom up command, and if the stick 170 or bucket 180 slows down more, the controller can deliver a little more boom pump command.

In one example, if the stick 170 stalls, the dig stall recovery mode can include the controller 130 commanding the bucket 180 to curl to a different angle while at least one of the stick 170 or the bucket 180 continues the digging process.

In block 212, the controller 130 can deactivate the dig stall recovery mode after a certain time limit or after a velocity of the stick increases above a pre-determined threshold has been determined in block 210. For example the time limit can be about 1 second.

Thus, the controller 130 will continue in the stall recovery mode until deactivated in block 212. As noted, the controller 130 can deactivate the recovery mode after a predetermined amount of time has passed (by a fixed timer with fixed or ramp-down command). In one example, the dig stall recovery mode can last for a duration of 1 second or less and is then deactivated. In one example, the recovery command can ramp down to zero based on a function of time. For example the controller can deliver boom up commands of 100%, 50%, 25%, and then deactivate.

In one example, the dig stall recovery mode can last until a velocity (angular or cylinder velocity) of at least one of the stick 170 or the bucket 180 goes above a predetermined threshold. In some examples, the predetermined threshold can include the same predetermined threshold used to determine a stall, as discussed above. In other examples, the predetermined threshold to determine stall recovery can be a threshold different from the stall threshold and can be a second or a third predetermined threshold, respectively. Thus, the stick 170 (and/or bucket 180) continues to dig while the boom 160 is moved and if the stick velocity or the bucket velocity goes above a given threshold, the recovery mode is resolved, the control moves to block 212 and on to block 214. In another example, the controller 130 can deactivate recovery mode if the controller 130 determines from the sensors that the stall motion or force has subsided. In one example, even if velocity does not go over the predetermined threshold, if the stick position reaches an "end of dig position", as determined by the controller, then that can also trigger a "dig complete" condition that proceeds to 214 and 216.

As a special handling technique, the present system can include a recovery failure option. For example, the controller 130 can be configured such that after several stall recovery attempts, a recovery failure is triggered and the dig maneuver is terminated so the machine can proceed to dump the load. For example, the controller 130 can trigger a recovery failure using an attempt counter, the sum of total stalled time, or a loss of velocity of the stick within a predetermined time window. For example, if the attempts at stall recovery go above 3, then the recovery failure can be triggered.

Thus, the controller 130 can include an attempt counter defining a number of times the controller 130 has invoked the dig stall recovery mode during a given dig action, and if the attempt counter goes above the certain predetermined attempt limit, the dig stall recovery mode is terminated and the dig is considered complete.

As noted, special handling logic can also monitor the chassis or frame 102 for movement in block 220. Referring again to FIG. 1, in various examples, the excavator 100 can include a plurality of sensors 196 associated with the frame 102 to determine that the frame 102 is moving undesirably. For example, one or more sensors 196 can include IMU sensors and can determine a pitch of the frame 102, a longitudinal movement forward or a lateral movement to the side, or a rotation of the frame 102 where the rear tracks 108 raise up.

In some examples, the one or more sensors 196 can include a GPS receiver allowing for a 3D grade determination. Also, a camera 198 can be associated with the excavator 100 and visual odometry can be used by the controller 130 to determine movement. In general, visual odometry is the process of determining the position and orientation of a machine by analyzing associated camera images over time. Using visual odometry, the controller 130 can sense when chassis is moving due to computer vision processing.

In one example radar sensors can be used to detect movement of the frame 102. For example, radar can receive returns from the ground, allowing for detection of gross motion.

Using one or more of these techniques, if undesired movement of the frame 102 is detected during the dig process, the controller 130 can mitigate the dig process or the stall recovery process to scale the boom, stick, or bucket command magnitudes down or turn them off until such movement subsides. Thus, the controller 130 can mitigate or inhibit any of the work tool motions during the dig process whether the controller 130 has detected a stall or not.

Accordingly, the controller 130 can be configured to mitigate or inhibit movement of the boom 160, the stick 170, and the bucket 180 until the sensor 196 detect that the frame 102 has stopped moving. Thus, if the controller 130 detects machine movement at block 220 at any time during the dig process (including during a stall recovery at block 208), the controller 130 can be configured to operate in a movement inhibition mode, where the controller 130 mitigates recovery commands or disables the recovery commands until the movement stops and machine settles.

Thus, in one embodiment, a work machine can generally include the sensors 196 to detect movement of the frame 102, and the controller 130 can be coupled to the sensors 196 and configured to operate in a movement inhibition mode when the movement is detected. In one example, the movement inhibition mode can include the controller mitigating or inhibiting movement of one or more of the stick, boom, or bucket.

INDUSTRIAL APPLICABILITY

The present system is applicable during many situations in construction. For example, when operating an excavator machine or other work machines.

Figure 7:
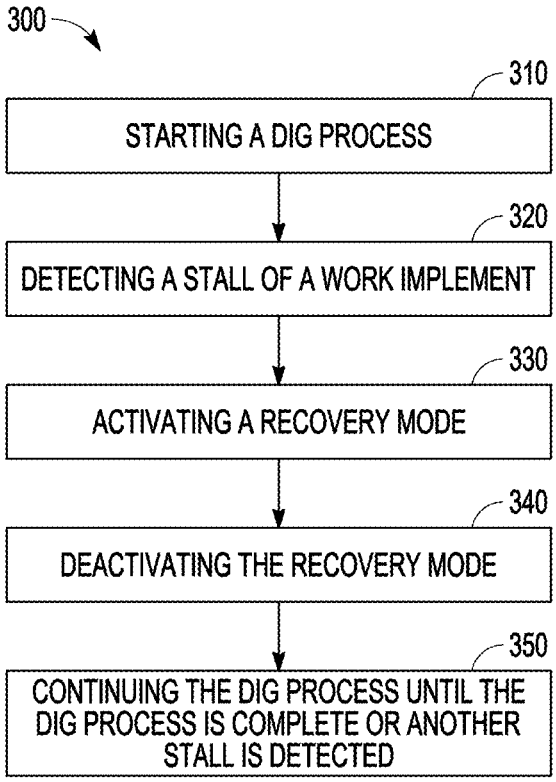
FIG. 7 shows a method for operating a work machine, in accordance with one embodiment.

FIG. 7 shows a method (300) for operating a work machine, in accordance with one embodiment. The method (300) can include starting a dig process (310), detecting a stall of a work implement (320), activating a recovery mode (330), deactivating the recovery mode (340), and continuing the dig process until the dig is complete or another stall is detected (350).

As discussed above, the detecting can include determining, when an implement function (the stick 170 or the bucket 180) is commanded to move, but insufficient motion of the implement or excessive force on the implement is observed. Activating the recovery mode can include commanding the boom to move with various boom up actions, as detailed above, and deactivating can include a time limit being applied or the stall being recovered from as determined by the sensors.

In one embodiment the method can further include a recovery failure option, as discussed above. Further, in any embodiment, the method can include monitoring for any chassis movement during a dig and taking appropriate action.

In summary, when an excavator digs in the ground, a stall can sometimes occur. If a stall happens, then the dig cycle either cannot proceed or the operator must abort the dig to dump with low payload which results in low productivity and low fuel efficiency. The present system provides a dig stall recovery system to detect the stall, activate a recovery action, and to deactivate the recovery action upon recovery. Further the present system includes a process for special handling for when recovery fails, or when the chassis or frame moves during a dig.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A work machine comprising:

a frame;

a work tool coupled to the frame wherein the work tool includes a boom, a stick, and a bucket combination;

a hydraulic system to provide power to operate the work tool;

one or more sensors coupled to the work tool to detect a velocity of the stick and the bucket or a force applied by the stick and the bucket; and a controller coupled to the sensors and configured to detect, during a dig process, a stall or an impending stall of one or more of the stick and the bucket from information from the sensors, and configured to operate the work tool in a dig stall recovery mode when the stall or the impending stall is detected, wherein the dig stall recovery mode includes commanding the boom to move upward in discrete boom up actions including boom pumping performed as multiple upward movements within a time window while at least one of the stick and the bucket continues the dig process.

2. The work machine of claim 1, wherein wherein the one or more sensors include IMU sensors.

3. The work machine of claim 1, wherein the dig stall recovery mode includes the controller moving the boom with modulated boom up actions while at least one of the stick and the bucket continues the dig process.

4. The work machine of claim 1, wherein time window for the dig stall recovery mode lasts for a duration of 1 second or less.

5. The work machine of claim 1, wherein the dig stall recovery mode includes the bucket curling to a different angle while the stick continues the digging process.

6. The work machine of claim 1, wherein the controller detects the stall or the impending stall when a velocity of at least one of the stick and the bucket falls below a predetermined threshold.

7. The work machine of claim 6, wherein the velocity of the stick is an angular velocity of the stick or a velocity of a hydraulic cylinder driving the stick and the velocity of the bucket is an angular velocity of the bucket or a velocity of a hydraulic cylinder driving the bucket.

8. The work machine of claim 1, wherein the controller is configured to detect the stall or the impending stall when a force applied to the bucket or the stick is above a predetermined threshold.

9. The work machine of claim 1, further including one or more motion sensors coupled to the frame, wherein the motion sensors are coupled to the controller and the controller is configured to detect, from the sensors, that the frame is moving, and the controller is configured to mitigate or inhibit movement of the boom, the stick, and the bucket until the sensor detects that the frame has stopped moving.

10. The work machine of claim 1, wherein the dig stall recovery mode lasts until one or more of a velocity of the stick goes above a second, predetermined threshold or a velocity of the bucket goes above a third, predetermined threshold.

11. The work machine of claim 1, wherein the controller includes an attempt counter defining a number of times the controller has invoked the dig stall recovery mode during a dig action, and if the attempt counter goes above a certain predetermined limit, the dig stall recovery mode is terminated and the dig is considered complete.

12. A system for controlling operation of a work machine, comprising:

a hydraulic system to provide power to operate a work tool of a work machine, the work tool including a boom, a stick, and a bucket combination;

a plurality of sensors coupled to the stick and the bucket; and a controller coupled to the sensors and configured to detect, during a dig process, a stall or an impending stall of one or more of the stick and the bucket from information from the sensors, and configured to operate the work tool in a dig stall recovery mode when the stall or the impending stall is detected, and then to deactivate the recovery mode and continue the dig process until another stall or impending stall is detected or the dig process is complete, wherein the dig stall recovery mode includes commanding the boom to move upward in discrete boom up actions including boom pumping performed as multiple upward movements within a time window while at least one of the stick and the bucket continues the dig process.

13. The system of claim 12, wherein if the controller detects another or impending stall, the controller re-activates the dig stall recovery mode, and then deactivates the recovery mode and continues to dig until another stall is detected or the dig is complete.

14. The system of claim 12, wherein the time window includes a time of 1 second or less.

15. The system of claim 14, wherein the controller deactivates the dig stall recovery mode after a certain time limit or after a velocity of the stick increases above a predetermined threshold or the velocity of the bucket increases above a pre-determined threshold.

16. The system of claim 12, wherein the controller includes an attempt counter defining a number of times the controller has invoked the dig stall recovery mode during a dig action, and if the attempt counter goes above a certain predetermined limit, the dig stall recovery mode is terminated and the dig is considered complete.

17. The system of claim 12, further including one or more motion sensors coupled to a chassis of the work machine, wherein the motion sensors are coupled to the controller and the controller is configured to detect, from the sensors, that the chassis is moving, and the controller is configured to mitigate or inhibit movement of the boom, the stick, and the bucket until the sensor detects that the chassis has stopped moving.

* * * * *